United States Patent [19]

Hergert

[11] Patent Number: 5,013,406

[45] Date of Patent: May 7, 1991

[54] TRAILING ELEMENT DEVICE FOR A HEADBOX

[75] Inventor: Richard R. Hergert, Rockton, Ill.

[73] Assignee: Beloit Corporation, Beloit, Wis.

[21] Appl. No.: 433,937

[22] Filed: Nov. 9, 1989

[51] Int. Cl.[5] ..... D21F 1/06

[52] U.S. Cl. ..... 162/343; 162/336; 162/344

[58] Field of Search ..... 162/343, 336, 339, 344

[56] References Cited

U.S. PATENT DOCUMENTS 4,566,945 1/1986 Ewald et al. ..... 162/343

4,617,091 10/1986 Rodal et al. ..... 162/343

*Primary Examiner*—David A. Simmons

*Assistant Examiner*—Thi Dang

*Attorney, Agent, or Firm*—Dirk J. Veneman; Raymond W. Campbell; David J. Archer

[57] ABSTRACT

A trailing element device is disclosed for use in a headbox of a papermaking machine. The device includes a plurality of laminated sheets, the sheets being disposed within the headbox for dampening turbulence within the headbox. A binder cooperates with the plurality of sheets for binding the sheets together such that the trailing element device defines an upstream bead which extends in a cross-machine direction within the headbox. The bead is anchored within a slot defined by the headbox such that the bead is permitted to pivot within the slot so that a downstream end of the trailing element device is permitted to freely float within the headbox for attenuating the turbulence within the headbox. A wear resistant cladding is applied to the upstream bead for inhibiting wear and fracturing of the sheets caused by frictional engagement between the trailing element device and the slot.

10 Claims, 2 Drawing Sheets

TRAILING ELEMENT DEVICE FOR A HEADBOX

BACKGROUND OF THE INVENTION

1. Field of the Invention

The present invention relates to a trailing element device for a headbox of a papermaking machine. More particularly, the present invention relates to a trailing element device which is disposed within a headbox of a papermaking machine for dampening turbulence of stock passing through the headbox.

2. Information Disclosure Statement

The CONVERFLO headbox design reduces turbulence of stock flowing through a headbox. CONVERFLO is a registered trademark of Beloit Corporation.

More particularly, the CONVERFLO headbox includes a plurality of trailing element devices disposed within a slice chamber of a headbox. Each of the trailing element devices is pivotally anchored at an upstream end of the slice chamber, such that the respective downstream ends of the trailing element devices freely float within the slice chamber.

By the aforementioned means, as the stock passes through the slice chamber in a converging path towards the slice lip thereof, the trailing element devices are permitted to move relative to each other, thereby dampening or attenuating turbulence within the headbox so as to achieve micro-turbulence within the ejected stock. Such micro-turbulence assists in providing a more uniform web. Additionally, such micro-turbulence maintains a more uniform basis weight across the width of the resultant web.

Such trailing element devices are typically anchored within the slice chamber by means of a dove-tail or triangular shaped slot defined by the upstream end of the slice chamber. The upstream end of each trailing element device is provided with an upstream bead or enlargement such that when the trailing element device is loaded into the slice chamber, the bead is anchored within the dove-tail slot, thereby allowing the trailing element device to be substantially anchored while permitting the downstream end of the trailing element to freely float within the headbox.

In practice, it has been found that due to the movement of the bead within the slot, wear and fracturing of the trailing element device has resulted.

Such wear has particularly occurred where different grade stocks have been applied to opposite sides of the trailing element device, such as in the STRATAFLO type headbox. STRATAFLO is a registered trademark of Beloit Corporation. In the STRATAFLO type headbox, a relatively inexpensive ply of secondary stock is covered by an upper high quality ply of stock, so that the resultant web has enhanced printing characteristics and a reduced cost. Nevertheless, when such dissimilar stocks are simultaneously ejected through a STRATAFLO headbox, a pressure differential of up to 20 pounds per square inch may be applied to the trailing element device, thereby tending to fracture the element particularly where the trailing element device contacts the edges of the dove-tail slot.

The present invention seeks to overcome the aforementioned problem by providing a wear resistant cladding to the trailing element device, such that wear and fracturing of the trailing element device is inhibited.

Therefore, it is the primary object of the present invention to provide a trailing element device that overcomes the aforementioned inadequacies of the prior art devices, and to provide a trailing element device that makes a considerable contribution to the papermaking art.

Another object of the present invention is the provision of a trailing element device in which the wear resistant cladding means inhibits wear and fracturing of the sheets caused by frictional engagement between the trailing element and the anchoring slots of a headbox.

Other objects and advantages of the present invention will be readily apparent to those skilled in the art by a consideration of the detailed description contained hereinafter, taken in conjunction with the annexed drawings.

SUMMARY OF THE INVENTION

The present invention relates to a trailing element device for a headbox of a papermaking machine. The device includes a plurality of a laminated sheets, the sheets being disposed within the headbox for dampening turbulence within the headbox. Binding means cooperate with the plurality of sheets for binding the sheets together such that the trailing element device defines an upstream bead which extends in a cross-machine direction within the headbox. The bead is anchored within a slot defined by the headbox such that the bead is permitted to pivot within the slot, so that a downstream end of the trailing element device is permitted to freely float within the headbox for attenuating the turbulence within the headbox. A wear resistant cladding means is applied to the upstream bead for inhibiting wear and fracturing of the sheets caused by frictional engagement between the trailing element device and the slot.

In a more specific embodiment of the present invention, the sheets are of graphite fibers for reinforcing the trailing element device.

The sheets are of rectangular configuration, and are staggered relative to each other such that the trailing element device is tapered with the device tapering from the upstream bead towards the downstream end.

The binding means is an epoxy resin and the outer surfaces of the trailing element device are of epoxy resin for imparting smoothness to the device.

In a preferred embodiment of the present invention, the device includes graphite fibers within the range 50 to 70 percent by weight and epoxy resin within the range 30 to 50 percent by weight.

The slot is of triangular cross-sectional configuration having an opening towards the downstream end of the trailing element device. Furthermore, the bead includes a central core which extends in a cross-machine direction. A plurality of upstream ends of the sheets are curved around the core such that the curved upstream ends and the binding means cooperate together to prevent the passage of the upstream bead through the opening, so that the device is anchored within the slot.

The wear resistant cladding means includes a metal sheath which extends around at least a portion of the outer surface of the upstream bead and extends therefrom towards the downstream end such that the metal sheath inhibits wear and fracturing of the sheets caused by frictional engagement between the trailing element device and the slot.

In a preferred embodiment of the present invention, the metal sheath is of stainless steel, the sheath having a hardness substantially equivalent to the hardness of the headbox for inhibiting wear and fracturing of the sheets.

The metal sheath is preferably bonded onto the outer surface of the laminated sheets.

Many modifications and variations of the present invention will be readily apparent to those skilled in the art by a consideration of the detailed description taken in conjunction with the annexed drawings. However, such modifications and variations do not depart from the spirit and scope of the present invention, as defined by the appended claims.

BRIEF DESCRIPTION OF THE DRAWINGS

Similar reference characters refer to similar parts throughout the various embodiments of the invention.

DETAILED DESCRIPTION OF THE DRAWINGS

Figure 1:
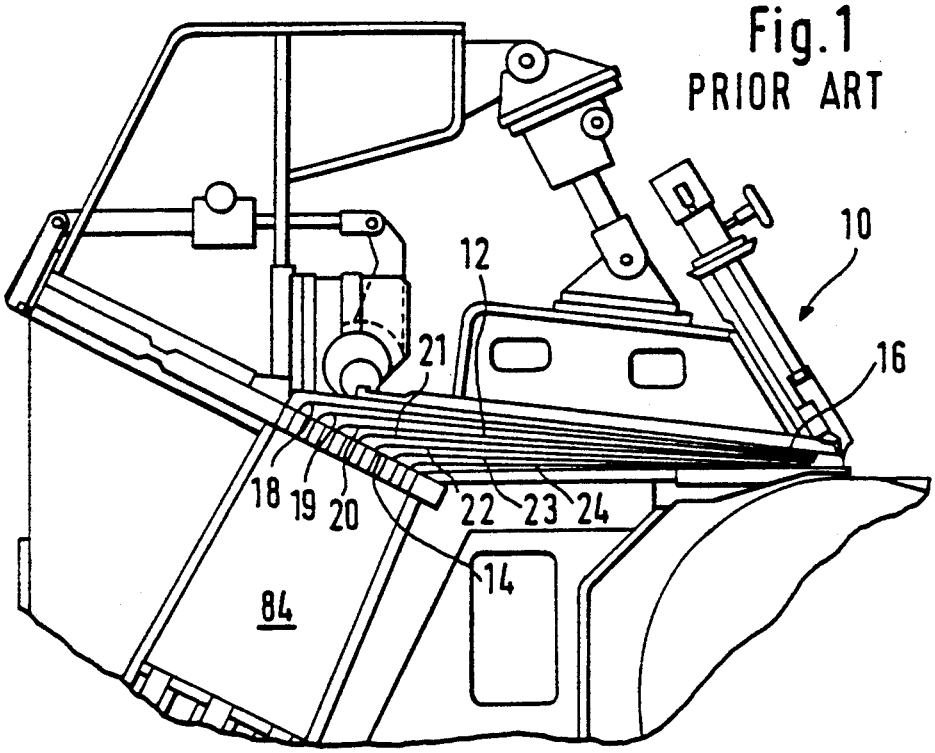
Fig. 1 PRIOR ART
FIG. 1 is a side-elevational view of a typical prior art thin channel CONVERFLO headbox including a plurality of trailing element devices.

FIG. 1 is a side-elevational view of a typical prior art CONVERFLO headbox generally designated 10. The headbox 10 includes a slice chamber 12 having an upstream and a downstream end 14 and 16 respectively. A plurality of trailing element devices 18, 19, 20, 21, 22, 23 and 24 are disposed within the slice chamber 12.

Figure 2:
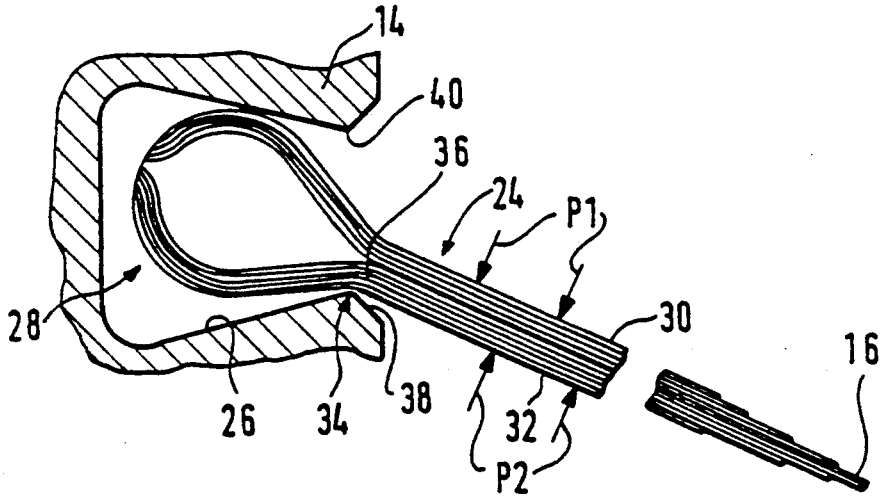
Fig. 2 PRIOR ART
FIG. 2 is an enlarged view of an upstream bead of a prior art trailing element device disposed within a dove-tail slot of a headbox.

FIG. 2 is an enlarged fragmentary view of one of the trailing element devices 24. The element 24 is anchored within a triangular or dove-tail slot 26 defined by the upstream end 14 of the slice chamber 12. The arrangement is such that each of the devices 18 to 24 is anchored at the upstream end 14 of the slice chamber 12 while the downstream ends of the trailing elements freely float within the slice chamber 12 for dampening turbulence of the stock passing through the slice chamber 12.

FIG. 2 shows an upstream bead generally designated 28 of the prior art trailing element device 24. The upstream bead 28 is disposed within the dove-tail slot 26. However, when a pressure indicated by the arrows P1 applied to the top side 30 of the device 24 is greater than the pressure represented by the arrow P2 applied to the lower side 32 of the device 24, frictional wear occurs in the vicinity of the point contact 34 between the root 36 of the upstream bead 28 and the edge 38 of the dove-tail slot 26. Such wear also occurs at a further edge 40 when the pressure P2 is greater than the pressure P1. Consequently, during use of the prior art trailing element devices, there exists a tendency for such elements to wear and fracture.

Figure 3:
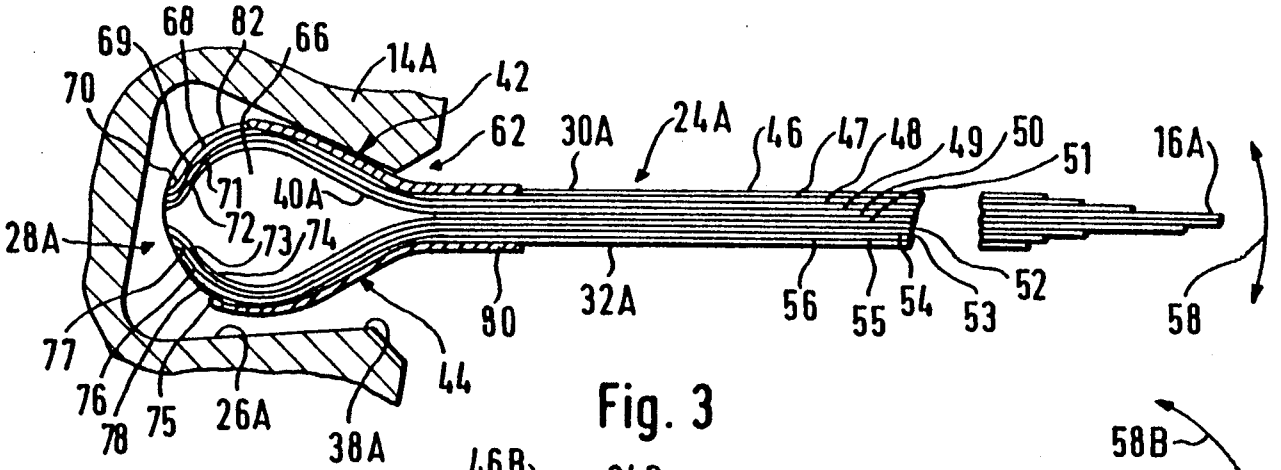
FIG. 3 is a view similar to that shown in FIG. 2, but shows a trailing element device according to the present invention in which the upstream bead includes a wear resistant cladding means.

FIG. 3 shows a trailing element device according to the present invention, and includes wear resistant means 42,44 applied to an upstream bead 28A for inhibiting wear and fracturing of the device. More specifically, FIG. 3 shows a trailing element device generally designated 24A for a headbox of a papermaking machine. The device 24A includes a plurality of laminated sheets 46, 47, 48, 49, 50, 51, 52, 53, 54, 55, and 56. The sheets 46 to 56 are disposed within a headbox for dampening turbulence within the headbox.

Binding means cooperates with the plurality of sheets 46 to 56 for binding the sheets together such that the trailing element device 24A defines the upstream bead 28A which extends in a cross-machine direction within the headbox.

The bead 28A is anchored within a triangular slot 26A defined by the upstream end 14A of the headbox such that the bead 28A is permitted to pivot as indicated by the arrow 58 within the slot 26A, so that a downstream end 16A of the trailing element device 24A is permitted to freely float within the slice chamber for attenuating the turbulence of stock flowing through the headbox. The wear resistant cladding means 42 and 44 is applied to the upstream bead 28A for inhibiting wear and fracturing of the sheets 46 to 56 caused by frictional engagement between the trailing element device 24A and the slot 26A.

More particularly, the trailing element device 24A includes sheets 46 to 56 which are of graphite fibers for reinforcing the device 24A. The sheets 46 to 56 are of rectangular configuration when viewed from above, and are staggered relative to each other such that the trailing element device 24A is of tapered configuration. As shown in FIG. 3, the device 24A is tapered from the upstream bead 28A towards the downstream end 16A.

In a preferred embodiment of the present invention, the binding means is an epoxy resin and the outer surfaces 30A and 32A of the device are of such epoxy resin for imparting smoothness to the device. The cladding means 42 and 44 are applied to the surfaces 30A and 32A respectively.

The device includes graphite fibers within the range 50 to 70 percent by weight, and epoxy resin within the range 30 to 50 percent by weight. In a preferred embodiment of the present invention, the graphite fibers are 60 percent by weight and the epoxy resin is 40 percent by weight.

The slot 26A is of triangular or dove-tail shaped cross-sectional configuration having an opening 62 towards the downstream end 16A of the trailing element device 24A. The bead 28A includes a central core 66 which extends in a cross-machine direction. A plurality of upstream ends 68, 69, 70, 71, 72, 73, 74, 75, 76, 77, and 78 of the sheets 46 to 56 are curved around the core 66 such that the curved upstream ends 68 to 78 and the binding means cooperate together to prevent the passage of the upstream bead 28A through the opening 62 so that the device 24A is anchored within the slot 26A.

The wear resistant cladding means 42,44 forms a metal sheath 80 which extends around at least a portion of the outer surface 82 of the upstream bead 28A. The sheath 80 extends from the upstream bead 28A towards the downstream end 16A such that the metal sheath 80 inhibits wear and fracturing of the sheets 46 to 56 by frictional engagement between the trailing element device 24A and edges 38A and 40A of the slot 26A.

In a preferred embodiment of the present invention, the metal sheath 80 is of stainless steel and has a hardness substantially equivalent to the hardness of the headbox for inhibiting wear and fracturing of the sheets.

The metal sheath 80 is bonded to the outer surface 82 of the bead 28A and the surfaces 30A and 32A of the laminated sheets 46 and 56, or may be formed integrally therewith during manufacture of the sheets.

Figure 4:
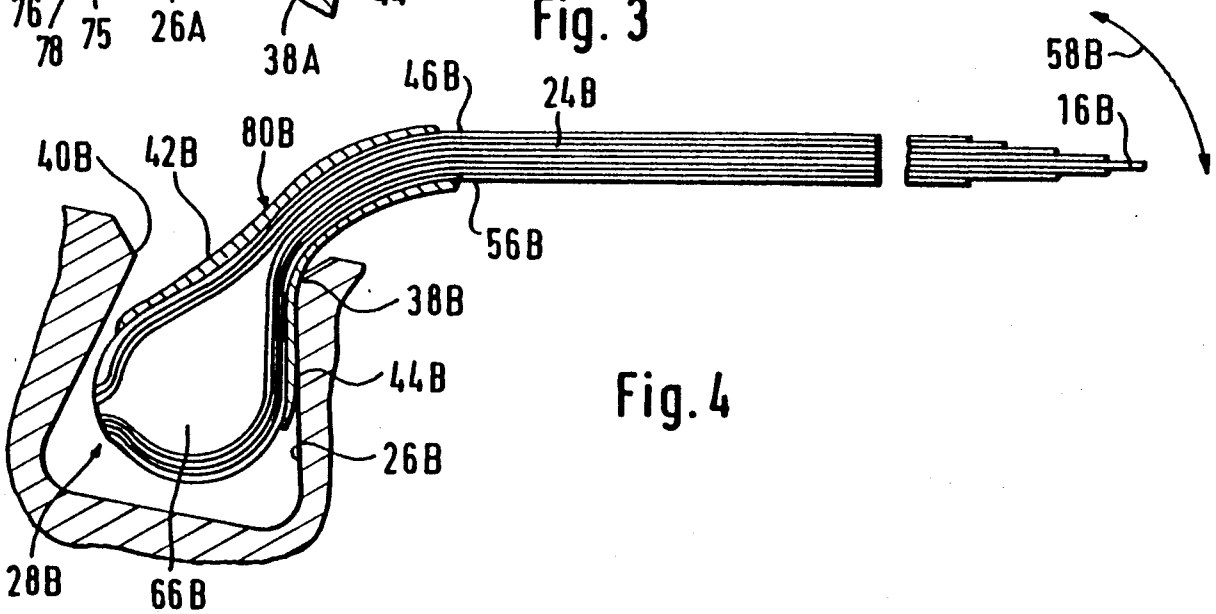
FIG. 4 is a similar view to that shown in FIG. 3, but shows a metal surface layer applied to the upstream bead of a trailing element device for a thin flow CONVERFLO headbox.

FIG. 4 is a similar view to that shown in FIG. 3 but shows a trailing element device 24B disposed within a thin channel CONVERFLO headbox of the type shown in FIG. 1.

In the thin channel CONVERFLO headbox, the stilling chamber 84, shown in FIG. 1, is angularly disposed relative to the slice chamber 12 such that the trailing elements 18 to 24 define therebetween relatively thin converging channels.

In the embodiment shown in FIG. 4, an upstream bead 66B has applied thereto cladding means 42B and 44B which form a sheath 80B around a portion of a bead 28B. The sheath extends from the bead 28B in a curved path towards the downstream end 16B of the device 24B such that wear between the edges 38B and 40B of the slot 26B and the sheets 46B and 56B respectively is inhibited.

In operation of the device according to the present invention, the trailing element devices are loaded laterally into the respective slots such that the elements are anchored therein and wear between the edges of the slots and the respective elements is inhibited.

The present invention provides a simple and inexpensive means for prolonging the life of trailing element devices of a CONVERFLO headbox, or the like.

What is claimed is:

1. A headbox of a papermaking machine having a trailing element device arranged therein, said trailing element device comprising:

a plurality of laminated sheets, said sheets being disposed within the headbox for dampening turbulence with the headbox wherein said sheets are staggered relative to each other such that said trailing element device is of a tapered configuration, said trailing element device tapering from said upstream bead toward said downstream end;

binding means cooperating with said plurality of sheets for binding said sheets together such that the trailing element device defines an upstream bead which extends in a cross-machine direction within the headbox;

said bead being anchored within a slot defined by the headbox such that said bead is permitted to pivot within said slot so that a downstream end of said trailing element device is permitted to freely float within the headbox for attentuating said turbulence within the headbox;

wear resistant cladding means applied to said upstream bead for inhibiting wear and fracturing of said sheets caused by frictional engagement between the trailing element device and said slot;

said slot being of triangular cross-sectional configuration, said slot having an opening toward said downstream end of the trailing element device;

said bead including:

a central core extending in a cross-machine direction;

a plurality of upstream ends of said sheets being curved around said core such that said curved upstream ends and said binding means cooperate together to prevent the passage of said upstream bead through said opening, so that said device is anchored within said slot; and said wear resistant cladding means including:

a metal sheath extending around at least a portion of the outer surface of said upstream bead, and extending therefrom towards said downstream end such that said metal sheath inhibits wear and fracturing of the sheets caused by frictional engagement between the trailing element device and said slot.

2. A headbox as set forth in claim 1 wherein said binding means is an epoxy resin.

3. A headbox as set forth in claim 2 wherein said sheets of are graphite fibers.

4. A headbox as set forth in claim 3 wherein said trailing element device includes graphite fibers within the range 50 to 70 percent by weight and epoxy resin within the range 30 to 50 by weight.

5. A headbox as set forth in claim 2 wherein the outer surfaces of the trailing element device are of epoxy resin for imparting smoothness to the trailing element device.

6. A headbox as set forth in claim 1 wherein said sheets are of graphite fibers for reinforcing the trailing element device.

7. A headbox as set forth in claim 1 wherein said sheets are of rectangular configuration.

8. A headbox as set forth in claim 1 wherein said metal sheath is of stainless steel.

9. A headbox as set forth in claim 1 wherein said metal sheath has a hardness substantially equivalent to the hardness of the headbox for inhibiting wear and fracturing of said sheets.

10. A headbox as set forth in claim 1 wherein said metal sheath is bonded onto the outer surface of said laminated sheets.

* * * * *